United States Patent [19]

Müller

[11] 4,372,133

[45] Feb. 8, 1983

[54] PUSHER NEEDLE

[75] Inventor: Jakob Müller, Stansstad, Switzerland

[73] Assignee: Textilma AG, Hergiswil, Switzerland

[21] Appl. No.: 206,291

[22] Filed: Nov. 12, 1980

[30] Foreign Application Priority Data

Nov. 29, 1979 [CH] Switzerland ..... 10618/79

[51] Int. Cl.[3] ..... D04B 35/04
[52] U.S. Cl. ..... 66/120
[58] Field of Search ..... 66/120

[56] References Cited

U.S. PATENT DOCUMENTS 1,946,030 2/1934 Morton ..... 66/120
2,229,929 1/1941 Morton et al. ..... 66/120

*Primary Examiner*—Ronald Feldbaum
*Attorney, Agent, or Firm*—Werner W. Kleeman

[57] ABSTRACT

A pusher needle wherein the oscillating movement in horizontal and vertical direction is replaced by an oscillating rotational movement affording an increase in the needle frequency, and thus, a production increase during the stitch formation. The oscillating rotational movement is caused by a curved construction of the pusher guide and the pusher portion displaceable therein.

4 Claims, 5 Drawing Figures

PUSHER NEEDLE

BACKGROUND OF THE INVENTION

The present invention relates to a new and improved construction of a pusher needle containing a guide for the pusher and also relates to use of the pusher needle.

The basis for increasingly using pusher needles instead of tongue needles is the desire to increase the production speed during stitch formation. During the brief pushing motion of the pusher of a pusher needle it is possible to attain decisively greater frequencies than in the case of oscillating to-and-fro movements of the tongue of a tongue needle.

A heretofore known pusher needle is of linear construction and consists of a head, shaft and foot or base. The head possesses an open hook and while the shaft is structured to have a guide for the pusher, the foot or base is provided with a cam or recess for movement control of the needle. The foot of the pusher likewise is structured for transmitting the pushing or displacing forward movement for closing the hook and a return movement for opening the hook. Although the pusher needle, in contrast to the tongue needle, renders possible increased production speeds during stitch formation, the required combination of a horizontal and a vertical to-and-fro movement of the pushing needle for forming a stitch constitutes a further limitation in relation to a still further production increase.

SUMMARY OF THE INVENTION

Therefore, it is a significant object of the present invention to provide a new and improved construction of a pusher needle which is not associated with the aforementioned drawbacks and limitations of the prior art proposals.

Another and more specific object of the present invention aims at overcoming the aforedescribed limitations and by providing an oscillatory needle movement in a single direction during the stitch formation to render possible a further production increase.

Now in order to implement these and still further objects of the invention, which will become more readily apparent as the description proceeds, the pusher needle of the present development is manifested by the features that the guide portion and the pusher portion displaceably guided within the guide portion are structured to possess a curved configuration.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
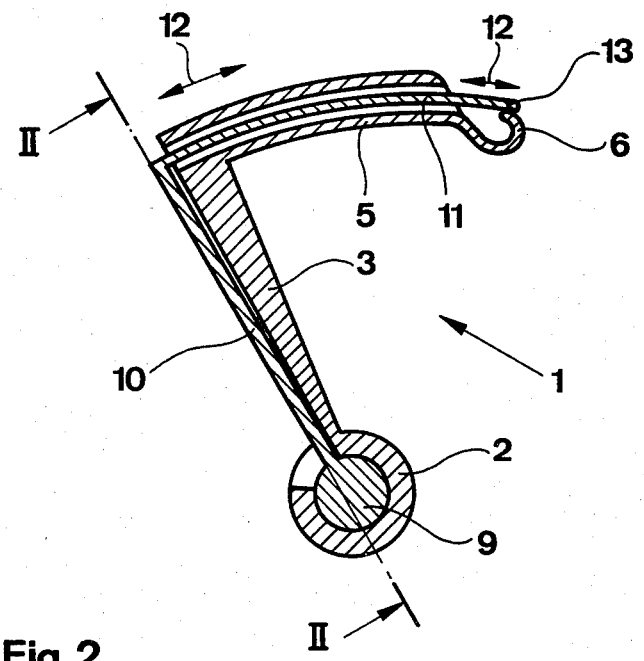
FIG. 1 is a front sectional view through the pusher needle central region, the section being taken substantially along the line I—I of FIG. 2.
Figure 2:
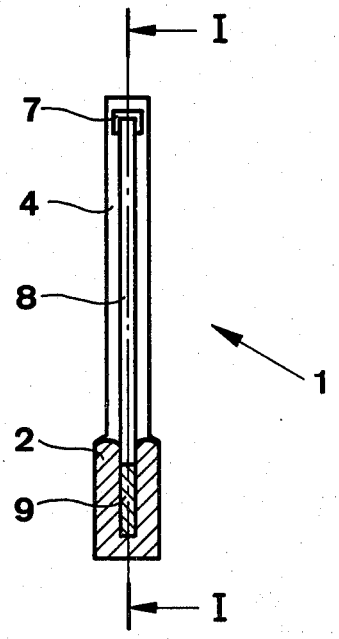
FIG. 2 is a schematic fragmentary sectional view of the pusher needle illustrated in FIG. 1, the section being taken substantially along the line II—II thereof.

Describing now the drawings, the pusher needle 1 illustrated by way of example in FIG. 1 will be seen to comprise a circular-shaped foot or base 2 having a substantially U-shaped cross-sectional configuration, as best seen by referring to FIG. 2. The foot or base 2 is connected with a radial shaft portion 3 of a shaft 4. The other part of the shaft 4 forms a substantially circular-shaped curved shaft portion 5 which is connected at right angles with the radially extending shaft portion 3. The head of the pusher needle 1 is configured to form an open hook 6. The curved shaft portion 5 constructed as a guide or guide means for a pusher portion has an opening 7 of essentially rectangular cross-sectional configuration.

A pusher 8 is provided and comprises a base or foot 9 constructed as a circular-shaped disc. The foot 9 is rotatably mounted in the substantially U-shaped recess of the needle base or foot 2. The pusher foot 9 is connected with a radial pusher portion 10 which continues in the form of a circular-shaped curved pusher portion 11 extending essentially at right angles to the radially extending pusher portion 10. This curved pusher portion 11 is displaceably guided in curved shaft portion 5 constructed as the guide means and serves to guide the aforementioned pusher portion of part 11.

During operation, the pusher needle 1, by rotating the foot 2, only accomplishes a movement forwardly or rearwardly in the direction of the double-headed arrow 12. By rotating the pusher foot 9 within the needle foot 2 the pusher 8 performs the same rotational movement, and during forward displacement of the pusher portion 11 through the guide means 5 its end 13 closes the opening of the hook 6, while during the rearward displacement the end 13 releases the opening of such hook 6. The control of the rotational movement of the pusher needle can be accomplished in conventional manner by a cam at the shaft portion or part 3 or at the foot 2 and the movement of the pusher 8 can be carried out likewise in conventional manner by a cam provided at the radial portion or part 10 or at the foot or base 9.

Figure 3:
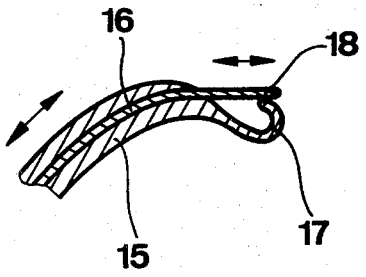
FIG. 3 is a fragmentary sectional view showing a variant construction of the pusher portion of a pusher needle.

With the merely partially illustrated pusher needle of FIG. 3 the shaft portion or part 15 and the pusher portion or part 16 are elliptically curved. So that the pusher portion 16 optimumly closes, in the closing position, the open hook 17 arranged at the inside of the curvature, its end 18 which covers the hook 17 is structured to be essentially straight or linear. Since the pusher portion 16 is formed of spring steel it readily accommodates itself to the curved channel cross-section of the shaft portion 15 upon opening the hook 17.

Figure 4:
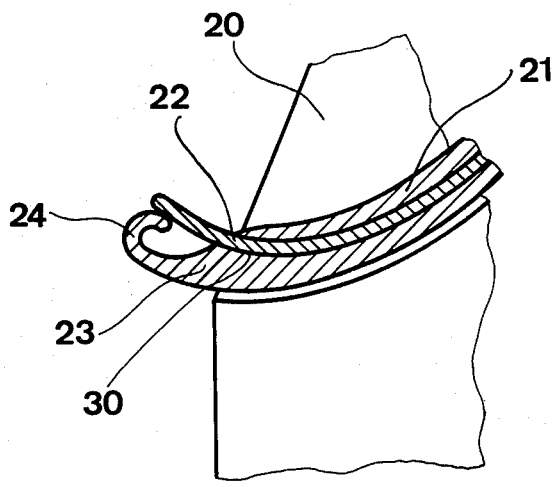
FIG. 4 is a sectional view through the pusher portion of a further construction of pusher needle.

FIG. 4 illustrates in fragmentary sectional view a pusher needle mounted in a curved needle bed 20. Since with this embodiment of pusher needle the end of the needle shaft 21 and the pusher portion 22 possess different curvatures, the guide channel 30 in the needle shaft end 23 is accommodated to the curvature of the pusher portion or part 22. Such construction of pusher needle is advantageous when the needle hook 24 is located at the outer side of the curvature of the pusher portion 22. Within the needle bed 20 the pusher needles are arranged adjacent one another so as to be individually moveable and controllable. However, they also can be arranged in groups in bars and the like and can be moved and controlled in groups within a bar bed.

Figure 5:
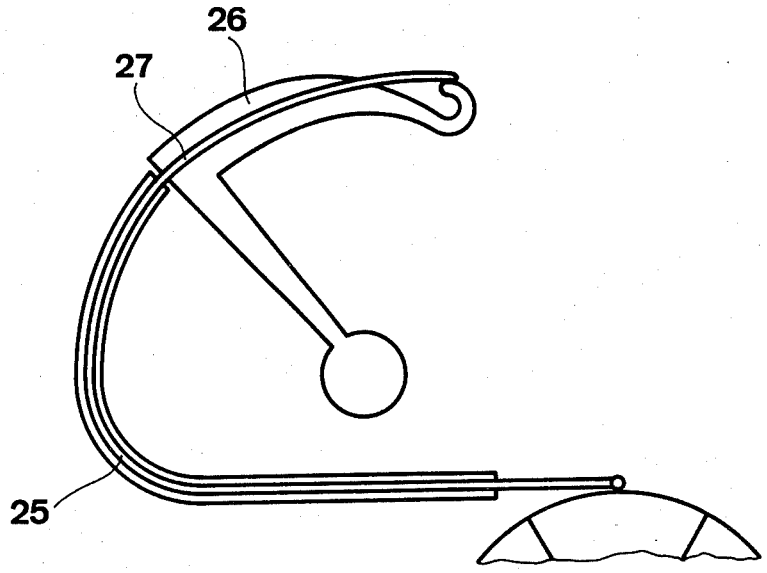
FIG. 5 illustrates a particular construction of a pusher of a further pusher needle.

A particularly interesting embodiment of pusher needle has been illustrated in FIG. 5. In this embodiment the pusher 25 does not have any radial portion parallel to the needle shaft, because the prolongation of the pusher part or portion 27 guided in the curved shaft portion 26 forms part of a Bowden cable. The construction of the pusher as a Bowden cable allows for an extremely precise pusher control.

The curvature of the pusher needle is chosen in such a manner that its rotational movement has the same relative movement of the open hook as in the case of a linear pusher needle resulting from the combination of the horizontal and vertical movements. This is true when the pusher needle is used as an individual needle, as individually controlled needles in the needle bed and as groupwise controlled needles in a bar arrangement or the like. With a circular-shaped curvature of the pusher needle the radius of curvature advantageously can be coordinated to the desired stitch size. However, the curvature is not limited to the circular configuration, it can possess any random suitable shape. The needle shaft portion and the pusher portion even can have different curvatures, but in such case the guide channel must be accommodated to the curvature of the pusher portion. Due to the sole oscillating rotational movement of the pusher needle and the curved pusher portion there can be obtained a further increase in the needle frequency, and thus, a production increase.

The curved shaft portion constructed as a guide means also can have a circular-shaped opening cross-section or it also can be structured as an open trough. The mutual coordination of the curved shaft portion and pusher portion to one another can be readily carried out and varied according to the judgment of one skilled in this technology. The same is equally true also for the remaining design of the inventive pusher needle.

While there are shown and described present preferred embodiments of the invention, it is to be distinctly understood that the invention is not limited thereto, but may be otherwise variously embodied and practiced within the scope of the following claims. Accordingly,

What I claim is:

1. A pusher needle comprising:

a rotatable foot portion;

curved shaft portion is connected at right angles with a radially extending shaft portion and to said rotatable foot portion for accomplishing oscillating movements of said shaft portion;

said curved shaft portion having a head configured to form an open needle hook;

said curved shaft portion possessing a curved opening extending therethrough;

a curved pusher portion is connected with a radial pusher portion, said curved pusher portion is guided in said curved opening for carrying out a sliding movement between a forward position, in which the open needle hook is closed, and a retracted position where the open needle hook is open; and said curved pusher portion being formed of spring steel and having a straight end covering said open needle hook in said forward position.

2. The pusher needle as defined in claim 1, wherein:

there are provided a plurality of said pusher needles used as individually movable and controllable pusher needles in a curved needle bed.

3. The pusher needle as defined in claim 1, wherein:

there are provided a plurality of said pusher needles; and said pusher needles are arranged as groupwise movable and controllable needles in a bar bed.

4. The pusher needle is defined in claim 1, wherein:

said straight end is movable past said needle hook in said forward position.

* * * * *